US008381895B2

(12) United States Patent
Howard et al.

(10) Patent No.: US 8,381,895 B2
(45) Date of Patent: Feb. 26, 2013

(54) DEVICE TO REDUCE NOISE TRANSMISSION THROUGH THE GAP BETWEEN ESCALATOR STEPS

(75) Inventors: Carl Q. Howard, Collinswood (AU); Andreas Stuffel, Bückeburg (DE); Larry W. Hardin, East Hartford, CT (US); Goldino S. Alves, South Windsor, CT (US)

(73) Assignee: Otis Elevator Company, Farmington, CT (US)

( * ) Notice: Subject to any disclaimer, the term of this patent is extended or adjusted under 35 U.S.C. 154(b) by 1355 days.

(21) Appl. No.: 10/585,386

(22) PCT Filed: Feb. 17, 2004

(86) PCT No.: PCT/US2004/004570

§ 371 (c)(1),
(2), (4) Date: Jul. 6, 2006

(87) PCT Pub. No.: WO2005/085118

PCT Pub. Date: Sep. 15, 2005

(65) Prior Publication Data

US 2007/0170038 A1 Jul. 26, 2007

(51) Int. Cl.
*B66B 23/12* (2006.01)

(52) U.S. Cl. ..... 198/333; 198/327

(58) Field of Classification Search ..... 198/325, 198/326, 333, 327

See application file for complete search history.

(56) References Cited

U.S. PATENT DOCUMENTS

| | | | | | |
|---|---|---|---|---|---|
| 4,374,558 | A * | 2/1983 | Saito | 198/333 |
| 4,413,719 | A * | 11/1983 | White | 198/333 |
| 4,638,901 | A * | 1/1987 | Lunardi | 198/323 |
| 5,295,568 | A * | 3/1994 | Saito et al. | 198/330 |
| 5,337,879 | A * | 8/1994 | Fischer | 198/333 |
| 5,560,468 | A * | 10/1996 | Inoue | 198/333 |
| 5,944,164 | A * | 8/1999 | Behle | 198/333 |
| 5,988,350 | A * | 11/1999 | Nusime et al. | 198/333 |
| 6,241,071 | B1 * | 6/2001 | Yamashita et al. | 198/333 |
| 6,543,599 | B2 * | 4/2003 | Jasinetzky | 198/333 |
| 7,063,202 | B2 * | 6/2006 | Ossendorf | 198/321 |
| 7,204,361 | B2 * | 4/2007 | Illedits | 198/326 |
| 7,264,105 | B2 * | 9/2007 | Illedits | 198/326 |
| 2007/0175730 | A1 * | 8/2007 | Jayachandran | |

FOREIGN PATENT DOCUMENTS

JP 61162484 7/1986

OTHER PUBLICATIONS

International Search Report dated Jan. 13, 2005, International Application No. PCT/US04/04570.

(Continued)

*Primary Examiner* — Douglas Hess
(74) *Attorney, Agent, or Firm* — Carlson, Gaskey & Olds PC

(57) ABSTRACT

A device (40, 50) for reducing noise levels in passenger conveyor systems (10) at least partially obstructs spacing (36) at the interface between two steps (24, 30) to allow for relative movement between one step and the next. A sound transmission reducing member (40, 50) at least partially obstructs a sound pathway that includes the spacing to reduce the transmission of noise through the spacing. The sound transmission reducing member in one example is a barrier that partially blocks the interface, while in another, it extends completely across the interface. Additionally, sound absorbing material (46) may be secured to the underside of the steps in order to further reduce sound transmission toward the passengers and individuals near the conveyer.

17 Claims, 3 Drawing Sheets

OTHER PUBLICATIONS

International Preliminary Report on Patentability dated Oct. 14, 2005, relating to International Application No. PCT/US04/04570.

Written Opinion of the International Searching Authority dated Jan. 13, 2005, International Application No. PCT/US04/04570.

* cited by examiner

DEVICE TO REDUCE NOISE TRANSMISSION THROUGH THE GAP BETWEEN ESCALATOR STEPS

FIELD OF THE INVENTION

This invention relates to reducing sound in passenger conveyer systems.

DESCRIPTION OF THE RELATED ART

Passenger conveyer systems, such as escalators, typically include a drive module connected to a step chain. The drive module which conventionally has been positioned beneath a landing at one end of the escalator, rotates the step chain which is connected to a plurality of steps, thus moving the steps. Drive modules can be relatively noisy. Additionally, vibrations from the operation of the conveyer system may contribute to the noise level in the vicinity of the escalator. The noise associated with operation of the passenger conveyer system can be annoying to individuals on or near the conveyer system.

Recently, escalator systems having the drive module in the incline have been introduced. This location may tend to increase noise levels. The drive module noise is easily transmitted toward the individuals through spacings between steps in the conveyer system. Such openings provide a path for sound to travel from the drive module out toward the passengers. The steps of a conveyer system must be spaced apart to allow movement relative to one another. Although the spacings are relatively small compared to the overall size of the conveyer system the spacings allow for an easy transmission path of the noise to the passengers.

Typical steps as known in the prior art are shown in FIG. 2. A first step 24 includes a first end 26 and a second end 28. A second step 30 includes a first end 32 and a second end 34. The first step 24 and the second step 30 typically have an interface located between them. A spacing 36 is located at the interface to allow for movement of the first step 24 relative to the second step 26. The spacing 36 allows for sounds or noise generated beneath the steps to emanate to an area where it can be heard by the individuals around the conveyer. The transmission of the noise is illustrated schematically by arrow 38. Further noise transmission may also occur through the steps themselves.

It is desirable to provide a conveyer system that is as quiet as possible. There is a need for a device that reduces the level of noise potentially heard by the passengers or individuals near the conveyer system. This invention addresses that need.

SUMMARY OF THE INVENTION

In general terms this invention is a device for reducing noise levels around passenger conveyor systems by limiting sound transmissions from beneath the steps.

One example system is a conveyer that includes a plurality of steps. There is a spacing at the interface between adjacent steps to allow for relative movement between one step and the next. A sound transmission reducing member at least partially obstructs a sound pathway that includes the spacing to reduce any transmission of noise through the spacing.

The sound transmission reducing member in one example is supported by one of the steps. The sound transmission reducing member in one example is an integral part of each step. In another example, it is adhesively secured to the step. The sound transmission reducing member in one example is a barrier that partially blocks the spacing at the step interface, while in another, it extends completely across the interface spacing.

One example device is a sound transmission reducing barrier that at least partially obstructs a sound pathway that includes the spacing between steps to limit or prevent any transmission of noise toward passengers and individuals near the conveyer. The barrier has a first portion that is adapted to be secured to a step and a second portion that at least partially blocks the spacing to prevent sound transmission. The second portion of the barrier may be a brush strip, a seal or a metallic flange.

In one example, sound transmission reducing material is secured to the underside of each step in order to further reduce sound transmission toward the passengers and individuals near the conveyer. The sound transmission reducing material in one example comprises foam.

The various features and advantages of this invention will become apparent to those skilled in the alt from the following detailed description of the currently preferred embodiment. The drawings that accompany the detailed description can be briefly described as follows.

DETAILED DESCRIPTION OF THE PREFERRED EMBODIMENTS

Figure 1:
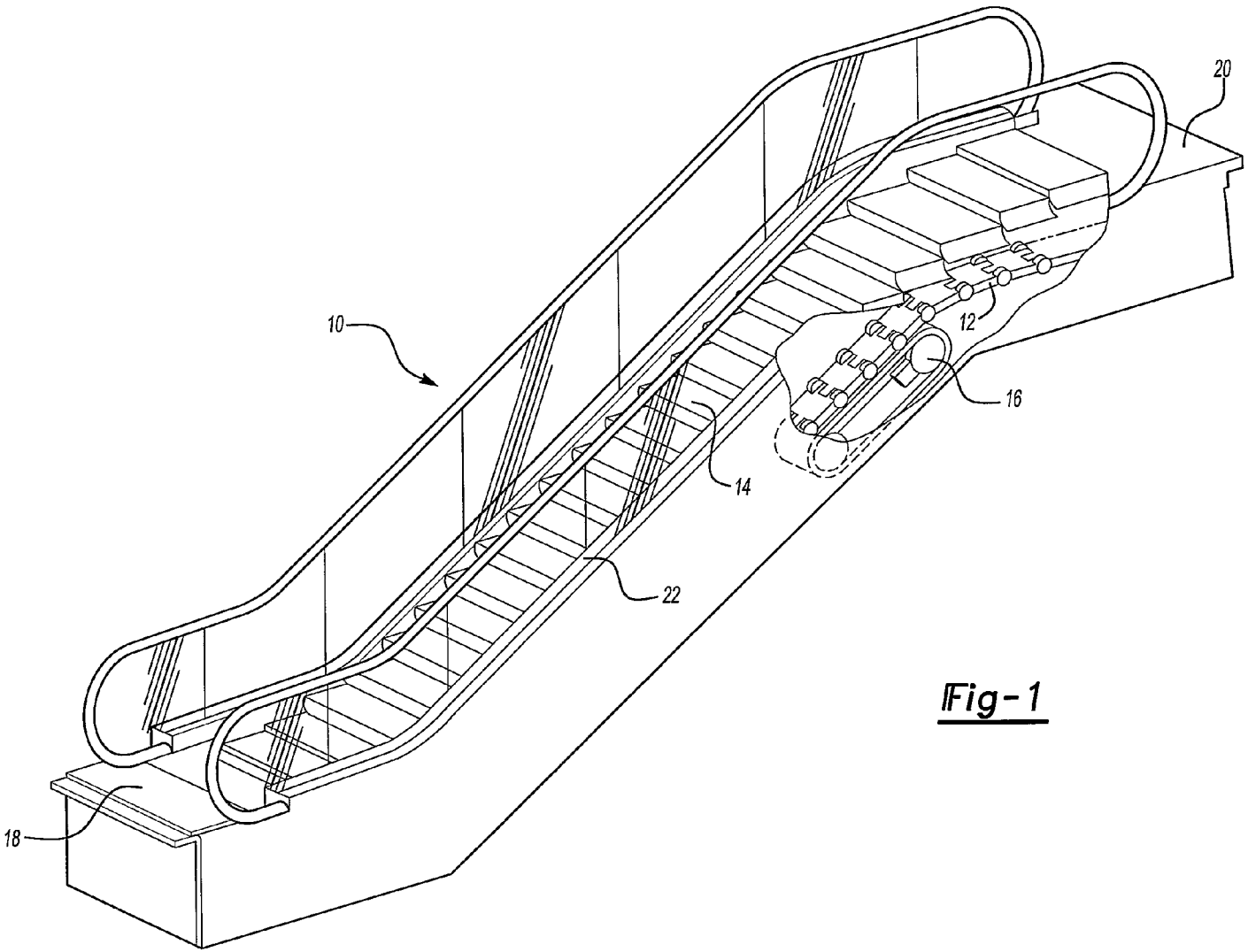
FIG. 1 is a general perspective view of an escalator system.
Figure 2:
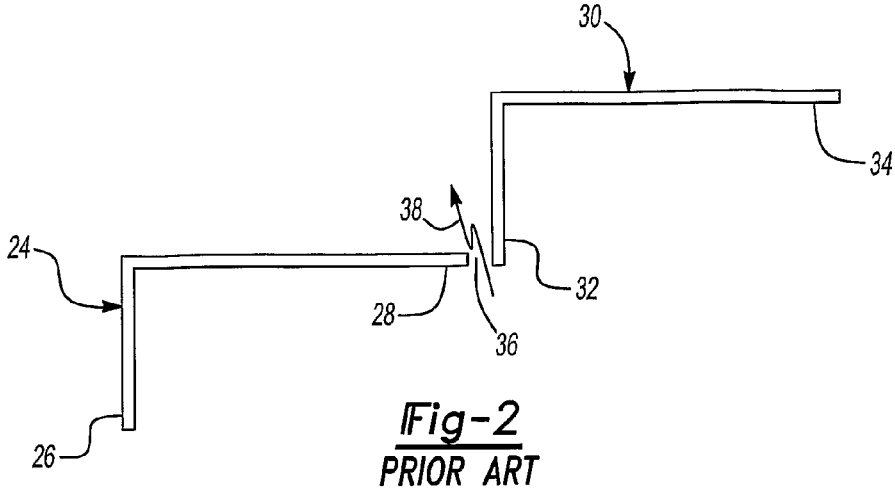
Fig-2 PRIOR ART
FIG. 2 is a schematic side view showing an interface between two steps typical of the prior art.

FIG. 1 illustrates a general perspective view of an escalator system 10. The invention may be applied to other conveyer systems, such as moving walkways, and is not limited to escalators, although that is the example shown for the purposes of discussion.

The escalator 10 includes a step chain 12, a plurality of steps 14, and a drive module 16 that causes selected movement of the step chain 12 and the steps 14 as known. The escalator 10 has a first landing 18 and a second landing 20 at opposite ends of an inclined midsection 22. The step chain 12 and steps 14 travel in a loop to carry passengers between the first landing 18 and the second landing 20. In the example embodiment, the drive module 16 is located in the inclined section 22 of the escalator 10.

Figure 3:
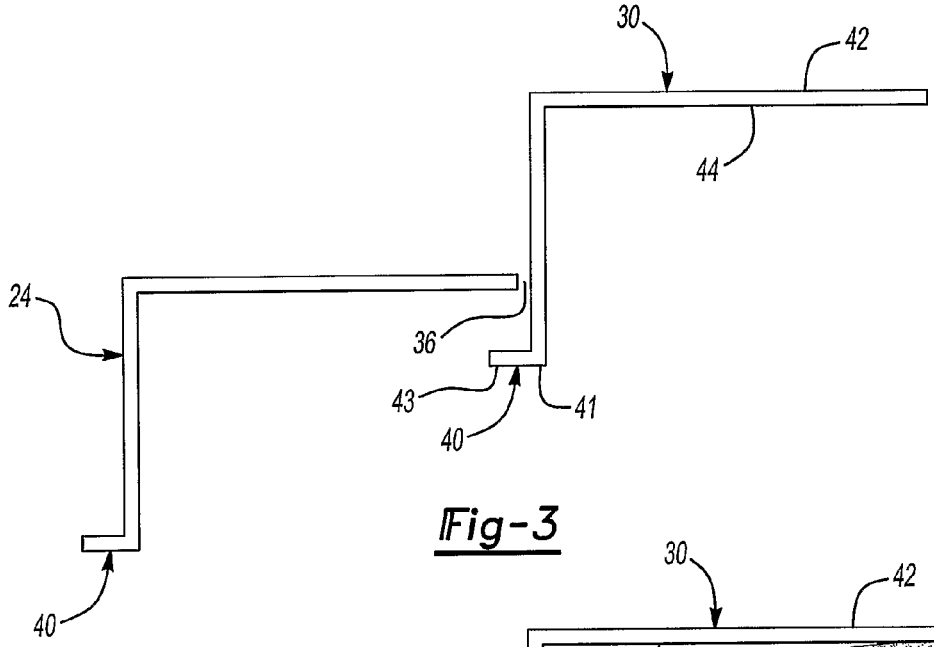
FIG. 3 is a schematic side view illustrating a first embodiment of this invention.

FIG. 3, illustrates a first embodiment of this invention to reduce the level of noise potentially heard by passengers. A first step 24 and a second step 30 have an interface located between them that includes a spacing 36 located at the interface to allow for movement of the first step 24 relative to the second step 30. The illustrated first and second steps are part of the entire set of steps and are typical of each step in one example.

A sound transmission reducing member 40 is positioned near an edge of each step near the interface between the steps. In the embodiment shown, the sound transmission reducing member is supported near a bottom edge of the steps. The sound transmission reducing member 40 provides a barrier that at least partially obstructs a sound pathway that includes the spacing 36. The sound transmission reducing member 40 eliminates the direct transmission path (i.e., forces sound wave diffraction) for at least some, and preferably all, of the airborne sound that otherwise would pass through the spacing 36. The sound transmission reducing member 40 interrupts the path otherwise followed by any noise from beneath the steps to where it can be heard. Although the spacing 36 is only partially blocked by the sound transmission reducing member 40, there is no longer a direct transmission path.

In one example, the sound transmission reducing member 40 is a lip integrally formed on each step. In another example, the sound transmission reducing member is a separate piece that is attached to the step using adhesives, fasteners, or other known means. The sound transmission reducing member 40 includes a first portion 41 and a second portion 43 that extends in a direction to obstruct a pathway including the spacing 36.

Figure 4:
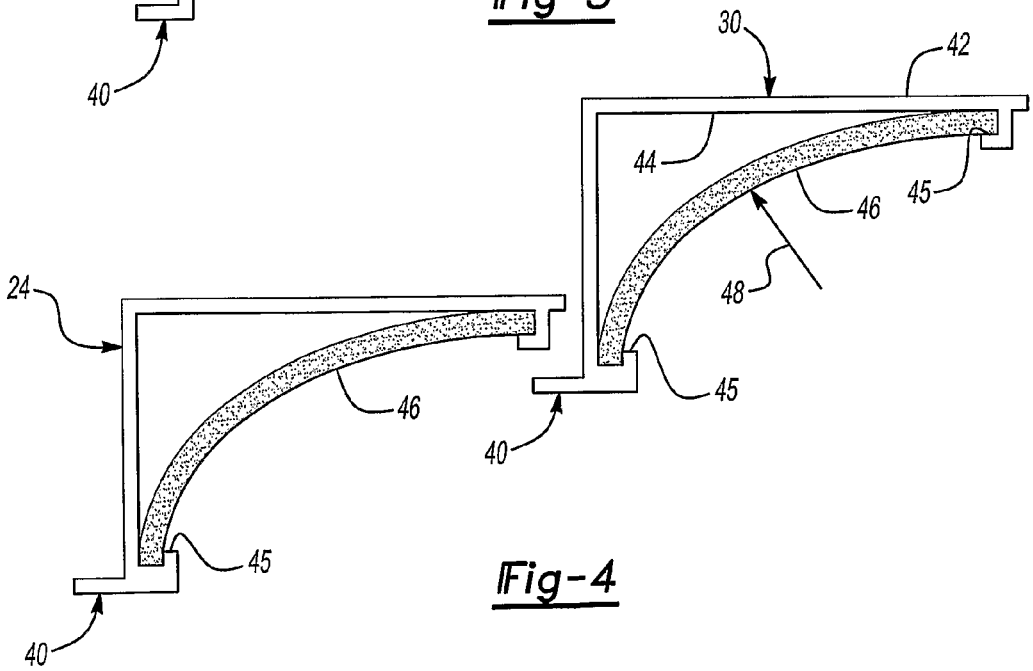
FIG. 4 is a schematic side view illustrating another embodiment of this invention.

FIG. 4 illustrates another embodiment. Each step has a tread surface 42 and a corresponding undersurface 44. To additionally reduce any sound transmission from beneath the steps, a sound transmission reducing material 46 such as foam or another known sound-absorbing material is positioned beneath the undersurface 44 of the steps. The sound transmission reducing material 46 in this example is supported in a desired position with ends received in notches 45 on the steps. Alternatively, the sound transmission reducing material 46 is a sprayed on foam, or attached by an adhesive, bolts or otherwise fixed in place. The sound transmission reducing material 46 absorbs or at least dampens the noise (schematically illustrated by arrow 48). The sound transmission reducing material 46 is additionally useful in reducing sound reverberation within an escalator chamber.

Figure 5:
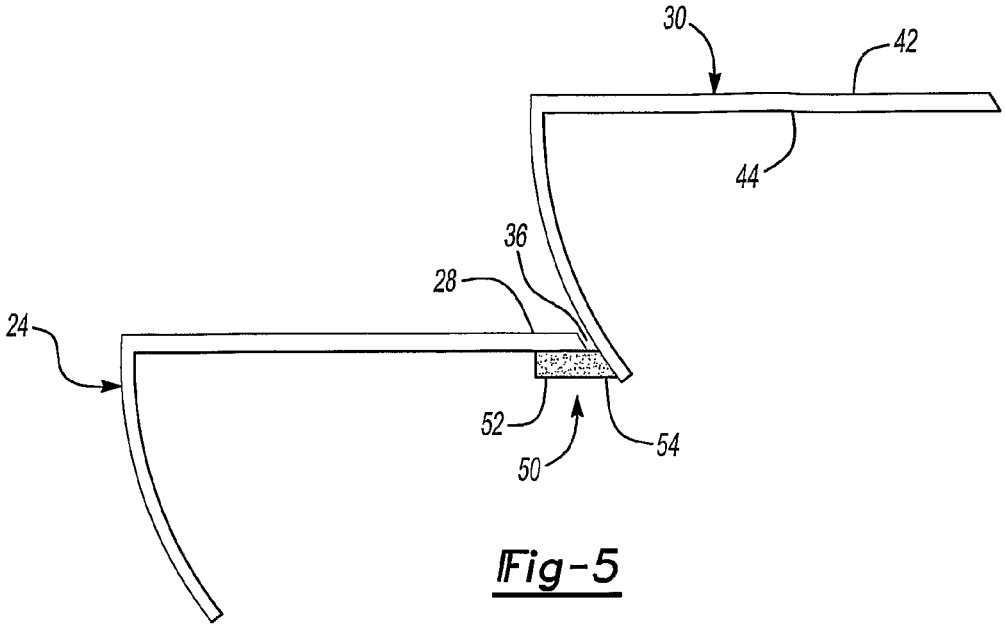
FIG. 5 shows another example embodiment of the invention

FIG. 5 illustrates another embodiment of the present invention. A barrier member 50 in this example comprises a seal that blocks the transmission path of the noise. The seal may be attached to either the first step 24, as illustrated, or the second step 30. The seal is attached to an end 28 near the interface of the first step 24 or the second step 30. A clip-on arrangement is used in one example. The seal in this example blocks the spacing 36 to reduce the transmission of noise through the spacing. In another example, the seal is supported on the step chain and positioned to block the gap between corresponding steps.

Figure 6:
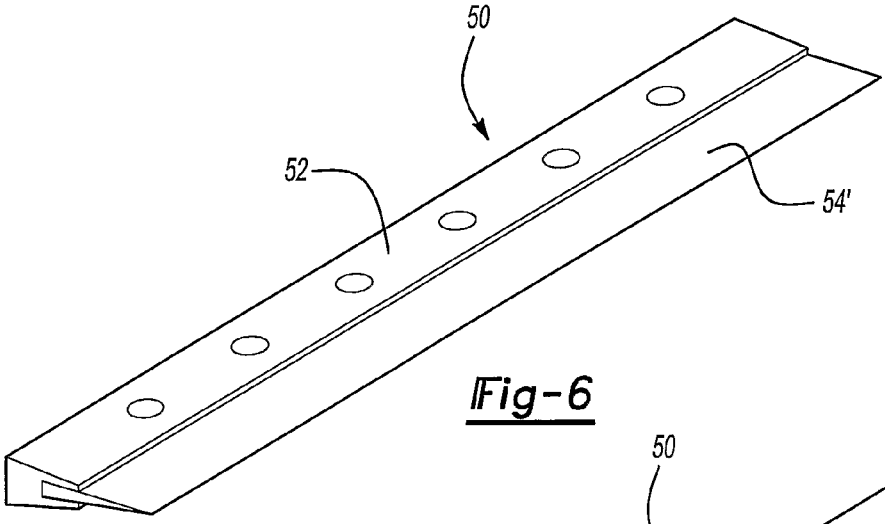
FIG. 6 shows an example having a seal member.
Figure 7:
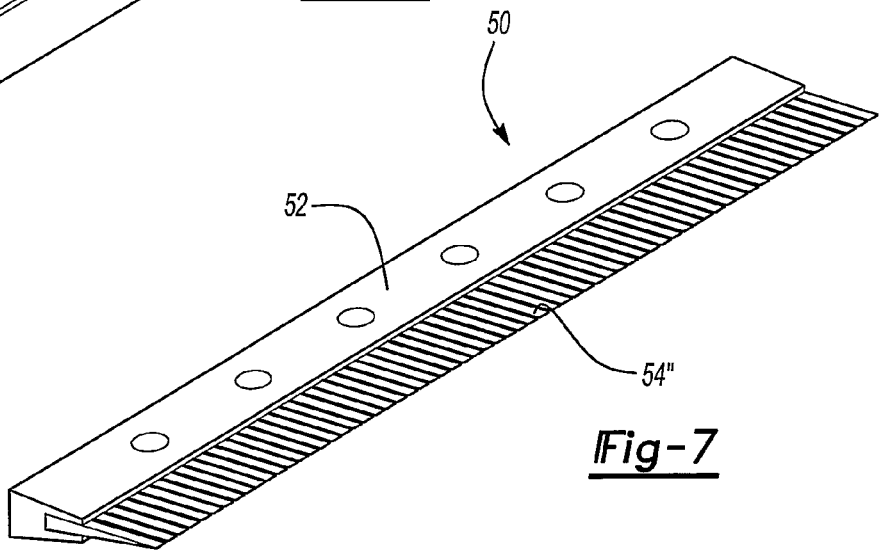
FIG. 7 shows an example having a brush strip.

In order to allow for movement of the first step 24 relative to the second step 30 the seal 50 is flexible. The seal 50 has a first portion 52 for attachment to a step and a second portion 54 for at least partially blocking the spacing 36. In this example, the seal 50 extends across the entire spacing 36. In FIG. 6, the second portion 54' is a solid, flexible material such as a plastic or rubber. In the example of FIG. 7, the second portion 54" is a brush strip. The first portion 52 may be formed of a metal or plastic material. In one example, the second portion 54 extends across the entire spacing 36.

The sound transmission reducing material 46 may be attached to the underside 44 of each step in the example of FIG. 5 to further reduce the level of noise transmitting to the tread side 42 of the steps.

The foregoing description is exemplary rather than limiting in nature. Modifications and variations of this invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

We claim:

1. A passenger conveyer system comprising:

a first step;

a second step adjacent the first step with a spacing at an interface between the first step and the second step;

a sound transmission reducing member associated with the interface to at least partially obstruct a sound pathway that includes the spacing; and a sound insulating material that is distinct from the sound transmission reducing member supported on an underside of each step.

2. The conveyer system of claim 1, wherein the sound transmission reducing member is attached to at least one of the steps.

3. The conveyer system of claim 1, wherein the sound transmission reducing member is formed as a part of at least one of the steps.

4. The conveyer system of claim 1, wherein the sound insulating material comprises foam.

5. The conveyer system of claim 1, wherein the sound transmission reducing member comprises a lip extending from an end of one of the steps.

6. The conveyer system of claim 5, wherein the lip is integrally formed as part of the step.

7. The conveyer system of claim 1, wherein the sound transmission reducing member comprises a seal supported by one of the steps and having a portion extending across the spacing.

8. The conveyer system of claim 7, wherein the seal is a solid material.

9. The conveyer system of claim 1, wherein the seal comprises a brush strip having a portion extending across the spacing.

10. The conveyor system of claim 1, wherein the sound transmission reducing member eliminates a direct transmission pathway that includes the spacing.

11. A method of reducing sound in a conveyer system having a plurality of steps with a spacing at an interface between the steps comprising:

forming a sound transmission reducing member on at least one of the steps as a part of the one of the steps and made of the same material as the one of the steps to at least partially obstruct a sound pathway through the spacing; and attaching another sound transmission reducing member to the step.

12. A method of reducing sound in a conveyer system having a plurality of steps with a spacing at an interface between the steps comprising:

forming a sound transmission reducing member on at least one of the steps as a part of the one of the steps and made of the same material as the one of the steps to at least partially obstruct a sound pathway through the spacing; and providing sound absorbing material on a side of the step that faces a sound source.

13. A passenger conveyor system comprising:

a first step;

a second step adjacent the first step with a spacing at an interface between the first step and the second step; and a lip formed on at least one of the steps to be a part of the one of the steps and made of the same material as the one of the steps, the lip being positioned relative to the interface to at least partially obstruct a sound pathway that includes the spacing such that the lip is operative as a sound transmission reducing member.

14. The passenger conveyor system of claim 13, comprising a step insulating material that is different than the material of the steps supported on an underside of each step.

15. The passenger conveyor system of claim 14, wherein the sound insulating material comprises foam.

16. The passenger conveyor system of claim 13, comprising another sound transmission reducing member supported by one of the steps and having a portion extending across the spacing.

17. The passenger conveyor system of claim 16, wherein the other sound transmission reducing member comprises one of a solid material or a brush strip.

* * * * *